United States Patent [19]

Hone et al.

[11] Patent Number: 4,951,694

[45] Date of Patent: Aug. 28, 1990

[54] WIRE PICKLING APPARATUS

[75] Inventors: Michel R. Hone, St. Placide; Jacques R. Martel, Brossard, both of Canada

[73] Assignee: Stelco Inc., Burlington, Canada

[21] Appl. No.: 473,816

[22] Filed: Feb. 2, 1990

Related U.S. Application Data

[62] Division of Ser. No. 326,643, Mar. 2, 1989.

[30] Foreign Application Priority Data

Oct. 18, 1988 [CA] Canada ..... 580453

[51] Int. Cl.[5] ..... C23G 3/02

[52] U.S. Cl. ..... 134/64 R; 134/114

[58] Field of Search ..... 134/64 R, 64 P, 114, 134/122 R, 122 P, 15

[56] References Cited

U.S. PATENT DOCUMENTS

| | | | |
|---|---|---|---|
| 2,348,232 | 5/1944 | Travitman et al. | 134/122 R X |
| 2,536,208 | 1/1951 | Nystrom . | |
| 2,665,699 | 1/1954 | Pendleton . | |
| 3,048,504 | 8/1962 | Kompart | 134/122 R X |
| 3,445,284 | 5/1969 | Robinson, Jr. et al. . | |
| 3,803,996 | 4/1974 | Marshall | 134/64 R X |
| 3,896,828 | 7/1975 | Foster et al. | 134/64 R X |
| 4,592,784 | 6/1986 | Ghizzi | 134/64 R X |

FOREIGN PATENT DOCUMENTS

| | | | |
|---|---|---|---|
| 585073 | 10/1959 | Canada . | |
| 3039303 | 5/1981 | Fed. Rep. of Germany | 134/64 R |
| 2415151 | 9/1979 | France | 134/64 R |

OTHER PUBLICATIONS

Fundamentals of Fluid Mechanics, Gerhart and Gross, Addiston-Wesley, 1985, pp. 792-804.

*Primary Examiner*—Philip R. Coe
*Attorney, Agent, or Firm*—Sim & McBurney

[57] ABSTRACT

Novel pickling method and apparatus are described. A plurality of parallel side-by-side laterally-spaced wires is passed horizontally from end to end of an enclosed pickling zone and are countercurrently contacted by a wave of hot hydrochloric acid pickling liquor formed by a hydraulic jump and passing through the pickling zone submerging the wires. The pickling zone is enclosed at the sides and top and bottom by solid walls and at the ends by water curtains which prevent the egress of fumes of hydrochloric acid. The pickling zone is followed by a washing zone in the same enclosure as the pickling zone comprising further water curtains and wiper bars. The side walls of the enclosure include depending side walls from an upper enclosure portion and upwardly-opening channels at the upper extremity of side walls of a lower portion into which the depending side walls extend below water baths located in the channels to seal the side walls but permit wires to be restrung.

11 Claims, 4 Drawing Sheets

WIRE PICKLING APPARATUS

This is a division of Ser. No. 326,643, filed 3/12/89.

FIELD OF INVENTION

The present invention relates to the pickling of iron wires to remove impurities from the surface thereof, and in particular to an improved method and apparatus for effecting the same.

BACKGROUND TO THE INVENTION

In the galvanizing of wire by applying a zinc coating to the surface thereof or in other coating operations, it is necessary for the wire surface to be free from oxides and other impurities to obtain satisfactory adhesion of the zinc or other coating material. It is conventional to treat the iron wire after annealing and before galvanizing with hot hydrochloric acid, sulphuric acid or other acid to remove surface impurities, such as scale, grease and drawing compound, in an operation conventionally termed "pickling".

In a conventional pickling operation, a plurality of wires is drawn through a static open bath of heated hydrochloric acid, before being washed, fluxed and galvanized in line. Problems arise with this prior art procedure. The open nature of the bath and the requirement for elevated temperature operation result in hydrochloric acid fumes, which must be removed via fume hoods and vented from the working area to atmosphere, which gives rise to significant environmental pollution. The venting is never perfect, however, and working area contamination results.

In addition, the wires must be maintained submerged in the bath for the pickling to be effective. This requires the wires to be guided to below the surface of the bath at one end of the bath and then to be guided out from below the surface at the other end of the bath. These changes in direction apply stress to the wire, which can cause kinking of the wire, imposes limitations on the size of wire which can be drawn through the bath, and increases the energy required to draw the wire through the bath. Further, this arrangement provides a rethreading problem upon breakage of a wire.

The static nature of the operation relies on movement of the wire through the bath to remove the impurities. Varying conditions often exist in varying parts of the bath, leading to inconsistent pickling. The bath also must be replenished and replaced from time to time, since the effectiveness of the bath diminishes with time as the acid is depleted. Such replenishment is a difficult and time consuming operation, which causes significant downtime of the galvanizing time.

SUMMARY OF INVENTION

In accordance with the present invention, a significantly-improved procedure for effecting pickling of wire in rapid and effective manner is provided wherein a dynamic countercurrent flow of aqueous pickling liquor, generally hot hydrochloric acid but including other suitable pickling materials, for example, sulphuric acid, is effected within an enclosed environment through which the wire passes without change in direction.

By using a procedure which does not involve a change in direction of the wires through the pickling zone, the wire guides and sinkers employed with the conventional static bath operation are eliminated, as are the additional stresses on the wire and the consequent limitations on wire size and the additional energy requirements of the static bath operation.

In addition, by employing a dynamic countercurrent flow of pickling liquor, the pickling conditions to which each portion of each wire is subjected are effectively the same, so that inconsistency in the results of pickling is eliminated, and a more rapid pickling operation is achieved, permitting the pickling zone dimensions to be shortened.

Further, by enclosing the environment of the pickling operation, the necessity to handle and vent fumes is eliminated. The present invention eliminates the environmental and working area pollution problems of the prior art operation.

The ability to pass the wires through a dynamic pickling tank arises from the employment in the present invention of a flow of pickling liquor countercurrent to the direction of movement of the wire in the form of a wave which submerges the wire in the pickling zone.

Accordingly, in one aspect, the present invention provides a method of pickling wire, which comprises passing a wire, usually simultaneously a plurality of wires in side-by-side laterally spaced apart relation, horizontally from end to end of an enclosed pickling zone; and forming a wave of aqueous pickling liquor, usually hot hydrochloric acid, passing countercurrent to the direction of movement of the wire through the enclosed pickling zone having a height which submerges the wire during its passage through the pickling zone.

The wave of pickling liquor has a height which is greater than the static level of pickling liquor in pickling tank, which enables the wire to pass through the pickling zone without changing direction and yet be effectively contacted by and submerged in the pickling liquor.

The wave of pickling liquor is formed by employing the principle of the so-called "hydraulic jump" at the remote end of the pickling tank from entry of the wire. The principle of the hydraulic jump is well known and is documented, for example, in "Hydraulics and Fluid Mechanics" by E. H. Lewitt, (1959) pages 270 to 277. As described therein, a forced flow of fluid through a sluicing gate in a channel results in frictional losses which decrease the velocity of flow of the fluid. As the fluid exits the sluicing gate into a body of the fluid, the energy is balanced by an increase in the normal depth of the body of fluid and the formation of a standing wave, which then passes through the fluid. The hydraulic jump, therefore, is a transition between high velocity, low depth flow and low velocity, high depth flow.

Applying this principle to the pickling bath, by pumping pickling liquor through a slit opening located in a submerged location at the remote end of the tank at a supercritical flow velocity (Froude Number $>1$) and by providing an overflow weir at the other end of a rectangular cross-section tank, a standing wave or flume of liquor is formed in the tank above the static level of the liquor, which then passes at a subcritical flow velocity (Froude Number $<1$) to and overflows the wire at the other end of the tank. It is the transition from supercritical to subcritical flows which produces the hydraulic jump.

The relation between the initial or static depth, d, and the sequent depth, D, is given by the relationship:

$$D = d/2\,(\sqrt{1 + 8N^2} - 1) \quad (1)$$

wherein N is the Froude Number which is equivalent to $v/\sqrt{gd}$, V is the velocity of supercritical flow, and g is the gravitational constant. The relation between the supercritical flow velocity, v, the pump capacity, Q, the flume width, L (which generally corresponds to the width of the tank), and the initial depth, d, is given by the relationship:

$$v = \frac{Q}{Ld} \quad (2)$$

The relationship then can be substituted into the Froude number:

$$N = \frac{v}{gd} = \frac{Q}{Ld\,gd} = \frac{Q}{gL^2d^3}$$

so that $N^2 = Q^2/gL^2d^3$

The relationship (1) of sequent and initial depths then can be rewritten as:

$$D = \frac{d}{2}\left[\sqrt{1 + \frac{8Q^2}{g\,L^2d^3}} - 1\right] \quad (3)$$

which then provides the design parameters for the pump and the tank to produce a particular sequent depth D.

In addition, at the critical height, $H_c$, above the weir, the Froude Number is equal to unity, so that the flow velocity above the weir, V, is given by the relationship:

$$V = \sqrt{gh_c}$$

so that $h_c = V^2/g$

However, $V = Q/Lh_c$ $$\text{so that} \quad h_c = Q^2/L^2h_c^2g \quad (4)$$

$$\text{and} \quad h_c = (Q^2/gL^2)^{\frac{1}{3}}$$

The weir height, W, then is provided by the relationship:

$$W \lessapprox D - h_c \quad (5)$$

By employing these relationships, the complete design parameters for a particular tank may be determined.

As noted above, the pickling liquor employed is usually hot hydrochloric acid. The concentration and temperature of hydrochloric acid employed are chosen to achieve an adequate degree of pickling of the wires within the contact time of the wires by the pickling liquor.

Generally, the hydrochloric acid has a concentration of about 10 to about 50 wt % HCl, preferably about 20 to about 25 wt % HCl. The hydrochloric acid generally is employed at a temperature of about 50° to about 90° C., preferably 65° to about 75° C. The wave of hydrochloric acid and the wires contacted thereby pass countercurrently through the pickling zone at speeds which result in a contact time of the wires in the pickling zone of about 5 to about 20 seconds, preferably about 10 to about 15 seconds.

In addition to the method aspect of the invention, the present invention also includes novel pickling apparatus. In accordance with this aspect of the present invention, an apparatus for pickling wire comprises a housing having side walls, a top wall and a bottom wall and open at ends thereof. Means is provided for forming water curtains at the ends of the housing to provide an enclosure. A rectangularly cross-sectioned open-topped elongate tank extends longitudinally within the housing from an upstream location adjacent an entrance end of the housing towards a downstream location adjacent an exit end of the housing. The tank has an overflow weir at the upstream location and wave forming means at the downstream location for forming by a hydraulic jump in conjunction with pickling liquor in the tank a wave of pickling liquor passing from the downstream end and overflowing the weir at the upstream location. Means is provided for passing at least one wire, usually a plurality of wires arranged in side-by-side laterally spaced-apart relation, horizontally from the entrance end to the exit end of the housing at a location slightly above the open top of the tank at a level which permits the wire to be substantially submerged by the wave passing from the downstream location to the upstream location.

DESCRIPTION OF PREFERRED EMBODIMENT

Figure 1:
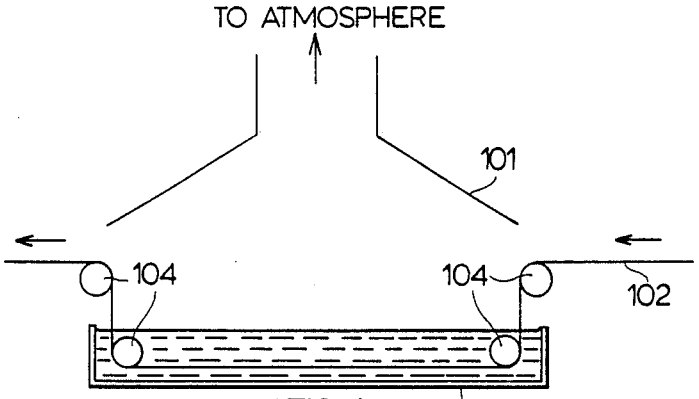
FIG. 1 PRIOR ART
FIG. 1 is an elevational view of a conventional prior art static pickling bath.
Figure 2:
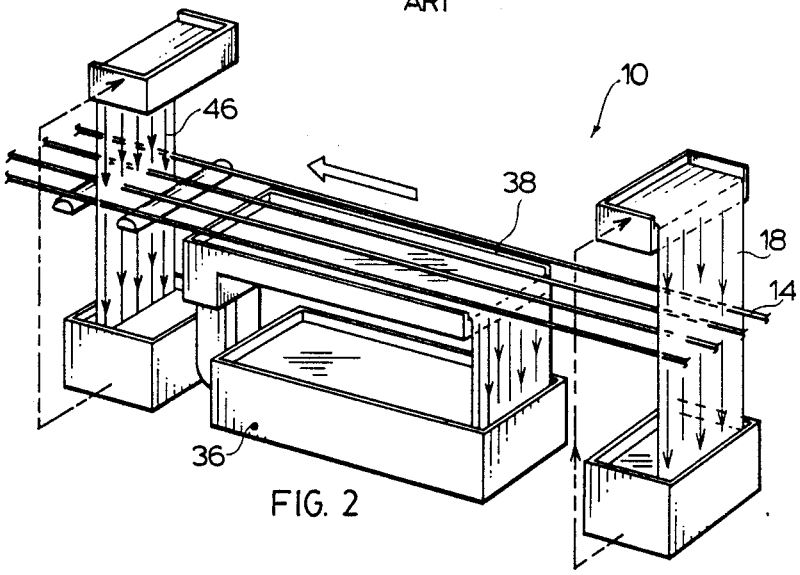
FIG. 2 is a schematic perspective view of a pickling apparatus in accordance with one embodiment of the invention with the bath in its static position.

Referring to the drawings, a wire pickling apparatus 10 comprises an inlet end 12 for a plurality of parallel laterally-spaced wires 14 and an outlet end 16 for the wires 14. The wires 14 pass horizontally from the inlet end 12 to the outlet end 16 without changing direction.

The wires 14 first pass through a water curtain 18 which is formed by overflowing a weir 20 from a water tray 21 while the wires 14 are supported on ceramic block supports 22, the water being collected in tank 24 and recirculated by pumps and pipes (not shown) to the water tray 21. The water tray 21 and associated weir 20 extend substantially across the width of the apparatus 10. The purpose of the water curtain 18 is to provide an air seal at the inlet end 12 to prevent hydrochloric acid fumes from escaping from the apparatus 10.

The weir 20 is provided in association with a cover 26 which extends for the length of the apparatus 10. The cover 26 has downwardly-extending side walls 28 which extend downwardly into a pair of channels 30 which also extend for the length of the apparatus 10. A water bath 32 is provided in the channels 30 which, with the walls 28, form side seals to prevent hydrochloric acid fumes from escaping through the sides. The cover 26 is suspended from overhead rails (not shown) which permits the cover to be separated entirely from the lower portion of the apparatus for access to the interior of the apparatus to be attained for servicing.

Drip legs 33 are provided at each side overlying the side seal to minimize the dripping of condensed hydrochloric acid into the side seal water bath 32 and to direct such condensed hydrochloric acid back into the bath thereof.

Figure 9A:
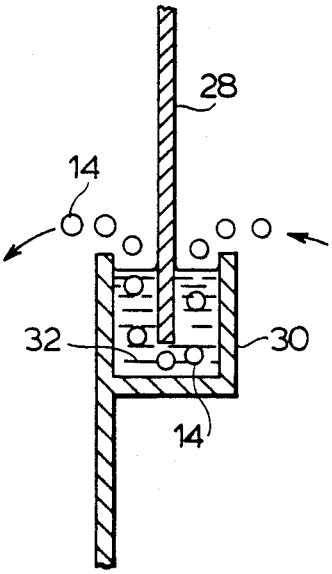
FIG. 9A is a close-up detail view of a portion of FIG. 9 illustrating rethreading of wires.
Figure 9:
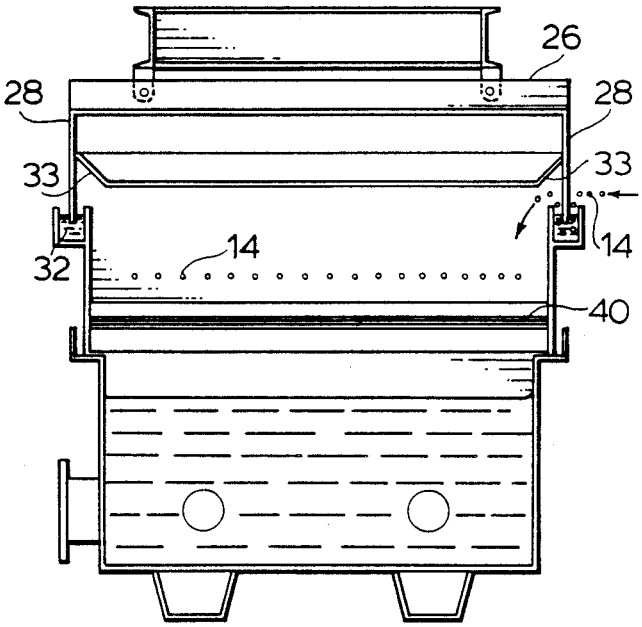
FIG. 9 is a transverse sectional view taken on line 9—9 of FIG. 5.

The arrangement of channels 30 and water bath 32 not only provides an efficient side seal with the depending walls 28 of the cover 26 which yet permit ready removal of the cover 26, if desired, but also permits simple restringing of wires 14 through the apparatus 10 without having to open the enclosure. All that is required is for the wire 14 to be passed from the exterior of the apparatus through the water bath 32 under the lower end of the walls 28 and into the interior of the apparatus 10, as seen schematically in the close-up view of FIG. 9A.

After passing the water curtain 18, the wires pass through an acid bath 33 countercurrent to and submerged beneath a standing wave 34 of heated hydrochloric acid. The acid bath 33 has a width substantially that of the apparatus and extends longitudinally within the housing. The acid bath 33 comprises a lower tank 36 containing a body of hydrochloric acid and an upper rectangularly cross-sectioned tank 38 in which the wave 34 is formed and from which hydrochloric acid overflows into the lower tank 36.

Figure 3:
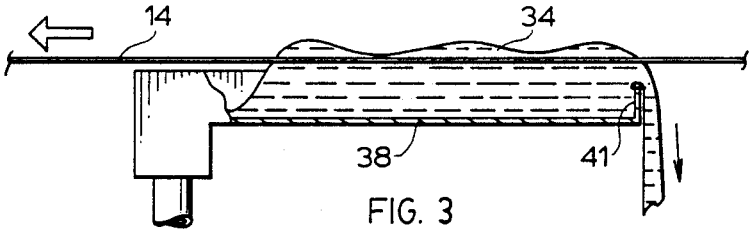
FIG. 3 is side elevational view of the pickling bath of the apparatus of FIG. 2 showing the relationship of the standing wave in the bath and the wires passing through the bath.
Figure 4:
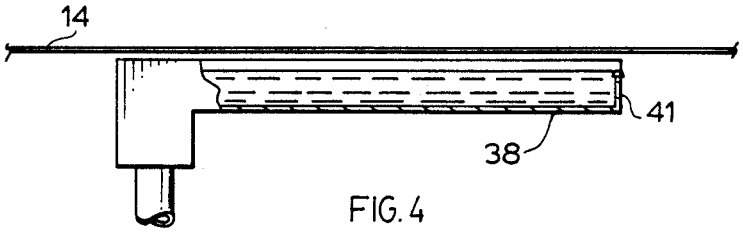
FIG. 4 is side elevational of the pickling bath of the apparatus of FIG. 2 showing the bath at rest.
Figure 5:
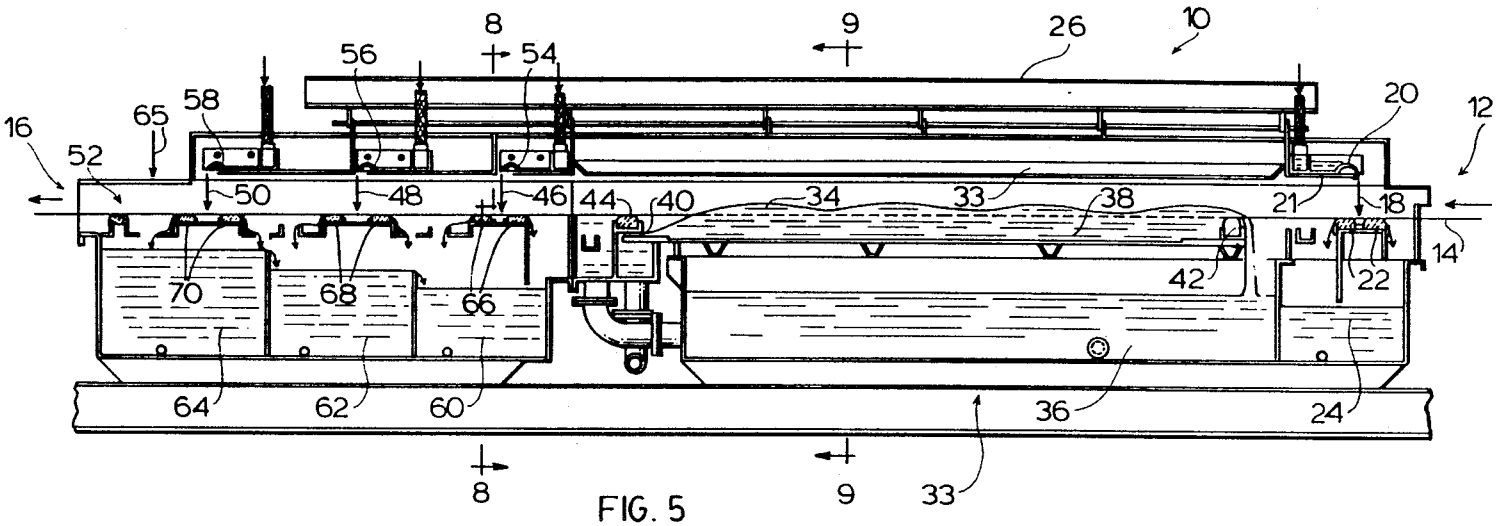
FIG. 5 is a side elevational longitudinally sectional view of the apparatus of FIG. 2 with the pickling tank operational.
Figure 6:
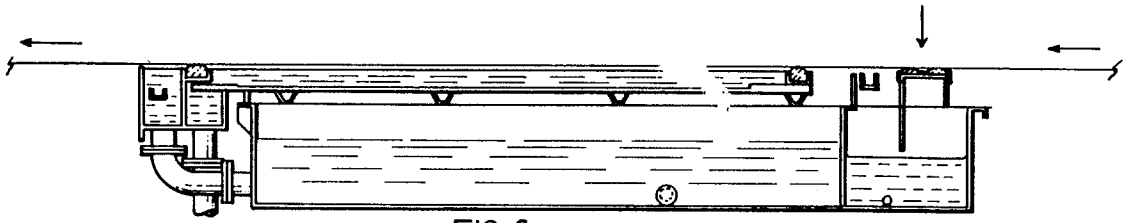
FIG. 6 is a side elevational view of the acid tank of the apparatus of FIG. 5 with the pickling tank static.
Figure 7:
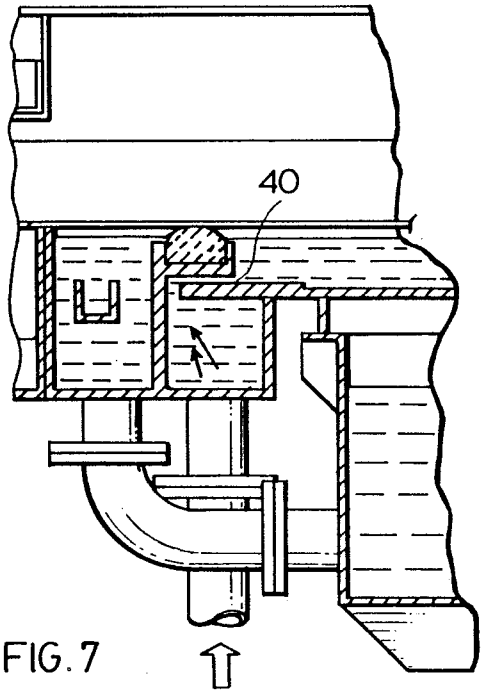
FIG. 7 is a close-up detail view of an end portion of the acid tank of FIG. 5.
Figure 8:
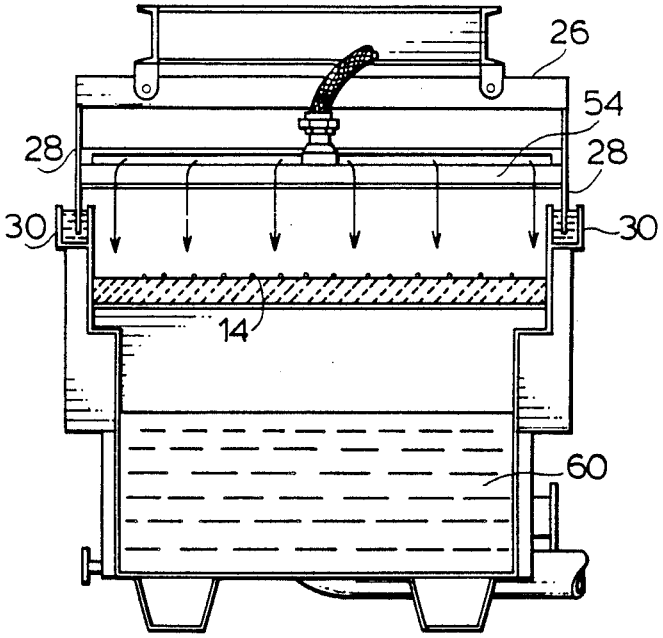
FIG. 8 is a transverse sectional view taken on line 8—8 of FIG. 5.

The wave 34 is formed by a hydraulic jump achieved by pumping recycled hydrochloric acid recycled from the lower tank 36 through an elongate slot 40 located adjacent the bottom wall and extending for the width of the upper tank 38 at the end of the tank remote from the water curtain 18. The hydraulic jump causes the wave 34 to be of a height greater than the depth of acid in upper tank 38 when at rest, and thereby to submerge the wires 14 as they pass horizontally through the apparatus 10. In this regard, comparison can be made between FIGS. 3 and 4 and FIGS. 4 and 6. The wave 34 overflows the end wall 41 of the upper tank 38 opposite to the slot 40 into the lower tank 36, so that the end wall 41 acts as a weir. The wires 14 are supported by transversely-extending ceramic blocks 42 and 44 during passage through the acid bath 33. The dynamic countercurrent motion of the wave 34 with respect to the wires 14 results in rapid, efficient cleaning of the wires.

The slot 40 is provided with a vertical dimension sufficient to permit the desired flow rate of hydrochloric acid therethrough. The slot 40 has a height which is in direct relation to the flow velocity and the ratio of the height of the liquor before and after the jump. The height typically is about 0.25 inches. The width of the slot 40 depends only on the volume of liquor to pass through the slot 40. The slot 40 also has a length suitable for obtaining the necessary jump of liquor.

The formation of the hydraulic jump and factors to be considered with respect thereto have been described in detail above. The tank 33 is dimensioned in length to enable a sufficient cleaning of the wires to be achieved without overpickling, which can be detrimental to satisfactory galvanizing or other coating operation.

Following completion of the acid treatment by the wave 34 in the tank 38, the wires 14 pass through a series of three water curtains 46, 48 and 50, which serve to rinse acid from the wires before passing over wiping bar 52, which removes excess wash water off the wires. The water curtain 46 also serves to prevent hydrochloric acid fumes from passing out of the region of the pickling tank 38 towards the end 16 of the apparatus 10. The apparatus 10 thus is sealed at the sides and both ends against escape of hydrochloric acid fumes.

The water curtains 46, 48 and 50 are formed by overflowing from respective weirs 54, 56 and 58 into water tanks 60, 62 and 64, in analogous manner to water curtain 18. Water overflows from tank 64 to tank 62 and then to tank 60. Water from tank 60 is pumped to tank 24 in a manner not shown. Make up water is fed to tank 64 by line 65. The wires 14 are supported on ceramic blocks 66, 68 and 70 during passage through the rinse water curtains, which act as wipers to remove liquid from the wires 14.

The pickling operation carried out with the apparatus 10 contrasts markedly with the prior art operation shown in FIG. 1. As seen therein, a static heated bath 100 is open to atmosphere and must be hooded by hood 101 and ventilated to inhibit excessive contamination of the work environment with hydrochloric acid fumes. In the present invention, the pickling operation is carried out in a totally enclosed environment so that hydrochloric acid fumes cannot escape.

In the prior art operation, the wires 102 are trained by ceramic rolls 104 to force the wires 102 beneath the surface of the heated bath, whereas, by virtue of the standing wave 34, the wires 14 pass through the pickling apparatus 10 of the present invention, without changing direction, resulting in an energy saving and less wire breakage.

Since the present invention uses a dynamic countercurrent cleaning operation, a much more consistent and effective cleaning operation results, when compared with the prior art. As a result of the dynamic conditions employed, as opposed to the static conditions of the prior art a much shorter acid tank can be employed than is the case with the static system.

SUMMARY OF DISCLOSURE

In summary of this disclosure, the present invention provides a novel countercurrent flow dynamic acid pickling procedure wherein a standing wave is formed in an acid pickling tank by a hydraulic jump, so that the wires can pass horizontally through the pickling and subsequent rinsing operation without changing direction. Modifications are possible within the scope of the present invention.

What we claim is:

1. An apparatus for pickling wire, which comprises:
   - an elongate housing having side walls, a top wall and a bottom wall and open at ends thereof,
   - means for forming water curtains at the ends of said housing to provide an enclosure,
   - a rectangularly cross-sectioned open-topped elongate tank extending longitudinally within said housing from an upstream location adjacent an entrance end of said housing towards a downstream location spaced from an exit end of said housing, said tank having an overflow weir at said upstream location and wave forming means at said downstream location for forming by a hydraulic jump in conjunction with pickling liquor in said tank a wave of pickling liquor passing from said downstream end and overflowing said weir at said upstream location, and means for passing at least one wire horizontally from said entrance end to said exit end of said housing at a location slightly above the open top of said tank at a level which permits said wire to be substantially submerged by said wave passing from said downstream location to said upstream location.

2. The apparatus of claim 1 wherein said housing comprises a lower portion and an upper portion, said lower portion including upwardly-opening elongate channels provided at the upper extremity of side walls of said lower portion and arranged to have a liquid housed therein, said upper portion including downwardly-depending side walls extending into said channels to terminate below the level of liquid in said channels so as to seal the sides of said housing, said upper portion being mounted to be movable out of the side-sealing relation of said depending side walls and said channels so as to enable access to the interior of the housing to be gained.

3. The apparatus of claim 2 wherein said housing further comprises additional means for forming at least one water curtain located between the ends of said housing adjacent the downstream end of said tank and dividing said housing into a pickling zone between said water curtain forming means at said entrance end of said housing and said additional water curtain forming means and a washing zone between said additional water curtain forming means and said water curtain forming means at said exit end of said housing.

4. The apparatus of claim 3 wherein at least one further water curtain forming means is provided between said additional water curtain forming means and said water curtain forming means at said exit end of said housing.

5. The apparatus of claim 4 further including wire wiping means located in said washing zone positioned to engage said at least one wire to remove liquid from the surface of said at least one wire.

6. The apparatus of claim 5 wherein each of said water curtain forming means comprises a water tray having a width substantially that of said housing located adjacent said top wall of said housing and having a weir extending along one longitudinal side thereof to permit water to overflow from said tray and form a downwardly-flowing curtain of water, sump means for collecting water from said curtain and recycle means for recycling said collected water from said sump to said tray.

7. The apparatus of claim 1 wherein said elongate tank has a width corresponding substantially to the width of said housing and said wave forming means comprises a slot located at said downstream end of said tank, extending for the width of said tank and located adjacent the bottom wall of said tank through which pickling liquid flows into said tank.

8. The apparatus of claim 7 wherein said tank has a pickling liquor static depth d and a width L, pump means associated with said wave forming means has a capacity Q, said weir has a height W, g is the gravitational constant and the sequent depth D of a wave of pickling liquor formed in said tank by said wave forming means is determined by the relationship:

$$D = \frac{d}{2}\left[\sqrt{1 + \frac{8Q^2}{g\,L^2 d^3}} - 1\right]$$

and the height of the weir is determined by the relationship:

$$W\ D - h_c$$

where $h_c$ is the critical height of the wave above the weir at which the Froude Number is unity and is determined by the relationship:

$$h_c = (Q^2/gL^2)^{\frac{1}{3}}.$$

9. The apparatus of claim 7 wherein said tank is located above a sump tank in such manner that pickling liquor overflowing said weir is collected in said sump and conduit means is provided connecting said sump to said wave forming means for recycling pickling liquor from said sump means to said wave forming means.

10. The apparatus of claim 9 wherein said tank has wire contacting means located at each longitudinal end of the tank to contact wires passing through said enclosure.

11. The apparatus of claim 9, wherein said means for passing at least one wire comprises means for passing a plurality of said wires arranged in parallel side-by-side laterally-spaced relation from said entrance end to said exit end of said housing at said location.

* * * * *